US005606883A

United States Patent [19]

Svec

[11] Patent Number: 5,606,883

[45] Date of Patent: Mar. 4, 1997

[54] DISPLAY AND DISPENSING DEVICE WITH LOCK SECURING STRUCTURE

[75] Inventor: Daniel C. Svec, Des Moines, Iowa

[73] Assignee: Schafer Systems Inc., Adair, Iowa

[21] Appl. No.: 410,141

[22] Filed: Mar. 23, 1995

[51] Int. Cl.[6] ..... E05B 9/08

[52] U.S. Cl. ..... 70/370; 292/DIG. 38; 70/63; 70/451

[58] Field of Search ..... 70/370, 451, 139, 70/63, 367; 292/DIG. 38

[56] References Cited

U.S. PATENT DOCUMENTS

| | | | |
|---|---|---|---|
| 2,040,258 | 5/1936 | Jacobi | 70/370 |
| 2,140,441 | 12/1938 | Clark | 70/370 |
| 2,329,158 | 9/1943 | Gill | 70/370 |
| 2,443,362 | 6/1948 | Tinnerman | 70/370 |
| 3,116,775 | 1/1964 | Russell | 292/DIG. 38 |
| 3,503,233 | 3/1970 | Russell et al. | 70/451 |
| 3,718,355 | 2/1973 | Canter | 292/321 |
| 4,139,998 | 2/1979 | Jeavon et al. | 70/370 |
| 4,145,978 | 3/1979 | Johnson et al. | 109/59 R |
| 4,245,374 | 1/1981 | Suzuki | 292/321 |
| 4,441,347 | 4/1984 | Taylor | 70/370 |
| 4,726,206 | 2/1988 | Hsu | 109/59 R |
| 4,823,571 | 4/1989 | O'Gara | 70/417 |
| 4,951,980 | 8/1990 | Wetzel | 70/451 |
| 4,995,507 | 2/1991 | Schafer . | |
| 5,100,038 | 3/1992 | Schafer . | |
| 5,116,091 | 5/1992 | Swift | 292/321 |
| 5,316,355 | 5/1994 | Hartwell et al. | 292/DIG. 38 |
| 5,435,159 | 7/1995 | Ramsauer | 70/370 |

FOREIGN PATENT DOCUMENTS

| | | | |
|---|---|---|---|
| 0221375 | 10/1986 | European Pat. Off. | 70/370 |
| 0315544 | 5/1989 | France | 70/370 |

*Primary Examiner*—Darnell M. Boucher

*Attorney, Agent, or Firm*—G. Brian Pingel; Brett J. Trout

[57] ABSTRACT

A hinged access display and dispensing device for lottery-type tickets includes a housing of box-like configuration with a door that is pivotally attached at a lower portion of the housing rear end. A lock assembly is secured in an upper portion of the door and has a head portion located adjacent the door exterior and a body portion extending from the head portion through the door. Projections are formed on the exterior of the lock assembly body portion and the door to coact with one another to secure the lock assembly in the door. In a preferred embodiment, the projections on the lock assembly are in the form of threads on the body portion and the projections on the door are in the form of tabs that extend into the grooves of the lock assembly body portion threads.

6 Claims, 3 Drawing Sheets

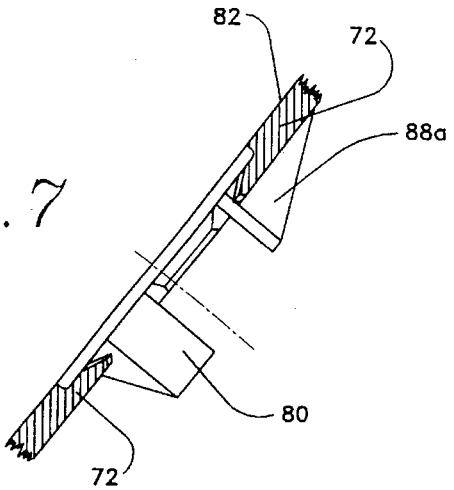
FIG. 7
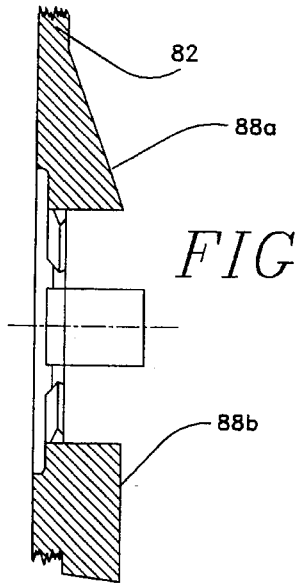
FIG. 6
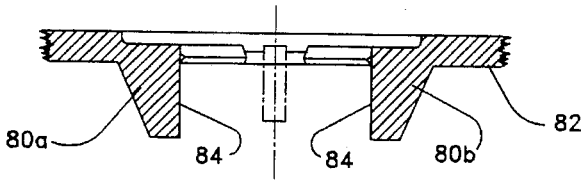
FIG. 8
FIG. 10
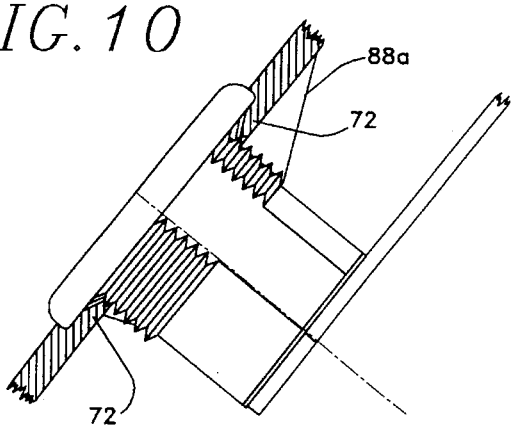
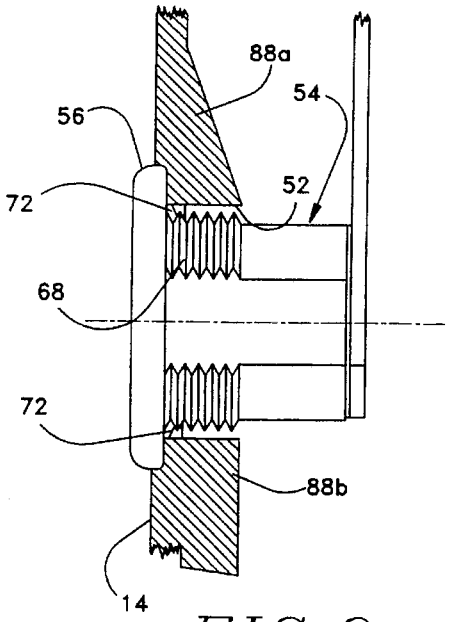
FIG. 9
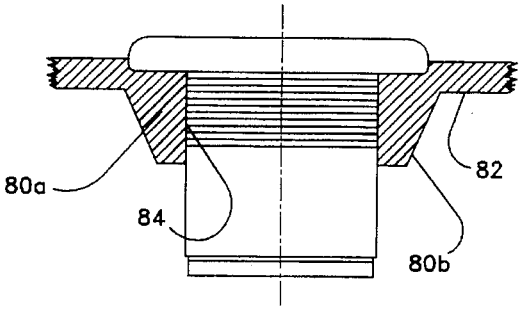
FIG. 11

DISPLAY AND DISPENSING DEVICE WITH LOCK SECURING STRUCTURE

BACKGROUND OF THE INVENTION

1. Field of the Invention

The present invention relates in general to a structure for the display and dispensing of tickets such as lottery tickets. More particularly, this invention relates to a device having a door pivotally attached at a lower portion of the rear end and a lock that is secured in an upper opening of the door by projections located on the lock and the door to semi-permanently secure the lock in the door.

2. Description of the Prior Art

The use of box-like structures for displaying and dispensing of tickets has been known for sometime. Generally, such dispensers have common characteristics such as transparent walls through which a stack of tickets may be seen, means for securing the dispenser in position and for preventing unauthorized removal of tickets therefrom, and a slotted portion through which the tickets may be manually dispensed.

Ticket dispensers are also known in the art that include a hinged rear door to provide access to the interior of the dispenser and a lock that is secured on the door and is operable by a key to secure the door in place. A typical lock construction, as shown in U.S. Pat. Nos. 5,100,038 and 4,995,507, includes a head portion adjacent the exterior surface of said door, a body portion that extends through an opening in the door and a latching arm attached to the body portion and movable into a locking position. As shown in the previously described patents, such lock structure is secured to the door by a nut that engages threads on the lock body portion and abuts against the interior surface of the door.

Although the prior art structure for securing a lock on a door is operationally effective, it suffers from the drawback of requiring extra time and a nut or clip for assembling the lock securely in place on the door. The present invention provides a display device with a lock securing structure that can be effected without the use of nuts or clips and in a shorter amount of time than that required by the prior art structure.

SUMMARY OF THE INVENTION

The present invention provides a hinged access display and dispensing device for use with lottery-type tickets. The device generally comprises a housing of box-like configuration having a pivotally mounted door at one end, a lock positioned in an opening of said door and means formed in said door and said lock to coact together to semi-permanently secure the lock in the door.

The lock includes a head portion located adjacent the exterior surface of the door, a body portion extending from said head portion through an opening in the door, and a latching arm portion connected to the body portion. Means are formed in the door and the lock to coact together to semi-permanently secure such members together.

The lock securing means are formed by projections on the exterior of the lock body portion and the periphery of the door opening, which projections engage one another to secure the lock in the opening. These projections are in the form of threads on the lock body portion and in the form of tabs on the door that extend from the periphery of said opening.

BRIEF DESCRIPTION OF THE DRAWINGS

FIG. 6 is a cross-sectional view taken along the line 6—6 of FIG. 4;

FIG. 7 is a cross-sectional view taken along the line 7—7 of FIG. 4;

FIG. 8 is a cross-sectional view taken along the line 8—8 of FIG. 4;

FIG. 9 is a cross-sectional view similar to FIG. 6 but with the lock shown in the door opening;

FIG. 10 is a cross-sectional view similar to FIG. 7 but with the lock shown in the door opening; and FIG. 11 is a cross-sectional view similar to FIG. 8 but with the lock shown in the door opening.

DETAILED DESCRIPTION OF THE PREFERRED EMBODIMENT

Figure 1:
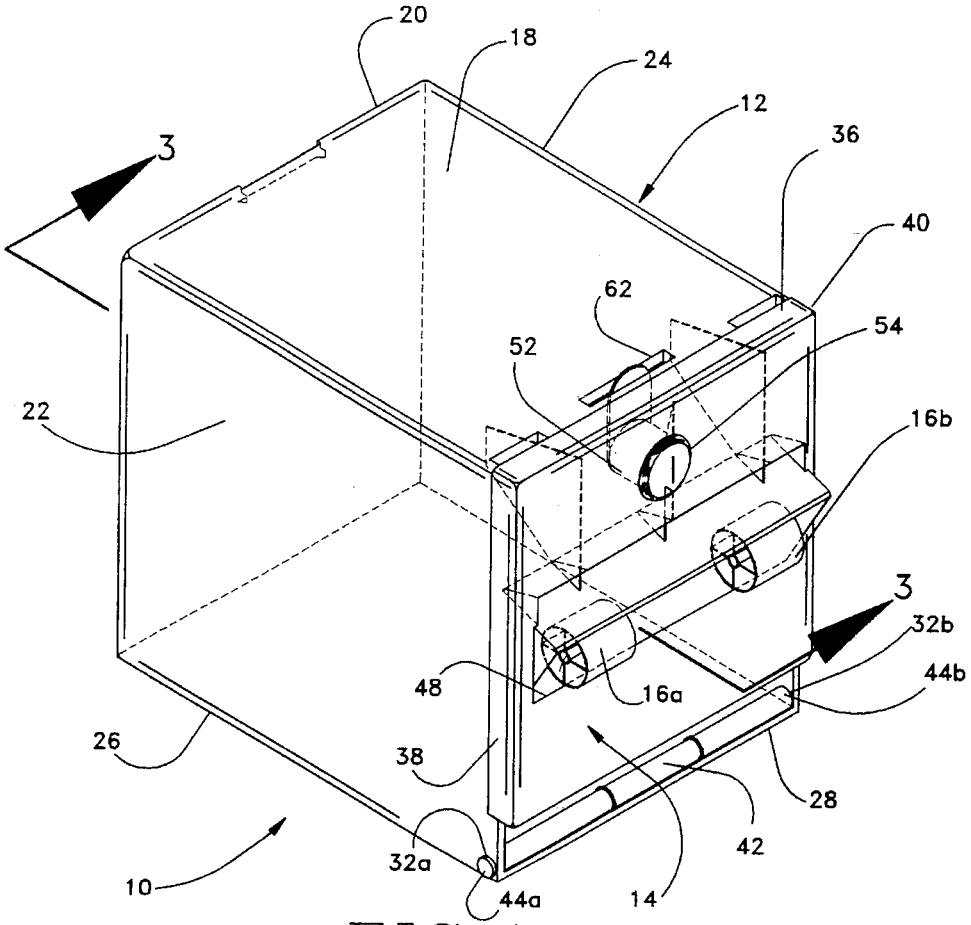
FIG. 1 is a rear perspective view of a preferred embodiment of a display and dispensing device with the lock securing structure of this invention.

With reference to the drawings, a preferred embodiment of a hinged access display and dispensing device of this invention is indicated generally at 10 in FIG. 1. Preferably the device 10 is utilized for displaying and dispensing lottery-type tickets on the counters of various types of retail establishments, such as convenience stores, that sell such tickets.

The device 10 includes a transparent, box shaped housing 12 and a door 14 with a pair of rollers **16*a* 16*b*. The housing 12 has a generally flat top surface 18, a front wall 20, a pair of opposite sidewalls 22 and 24, a bottom surface 26, and a rear open end 28, that allows access to the inside of the housing 12 when the door 14** is opened.

Figure 2:
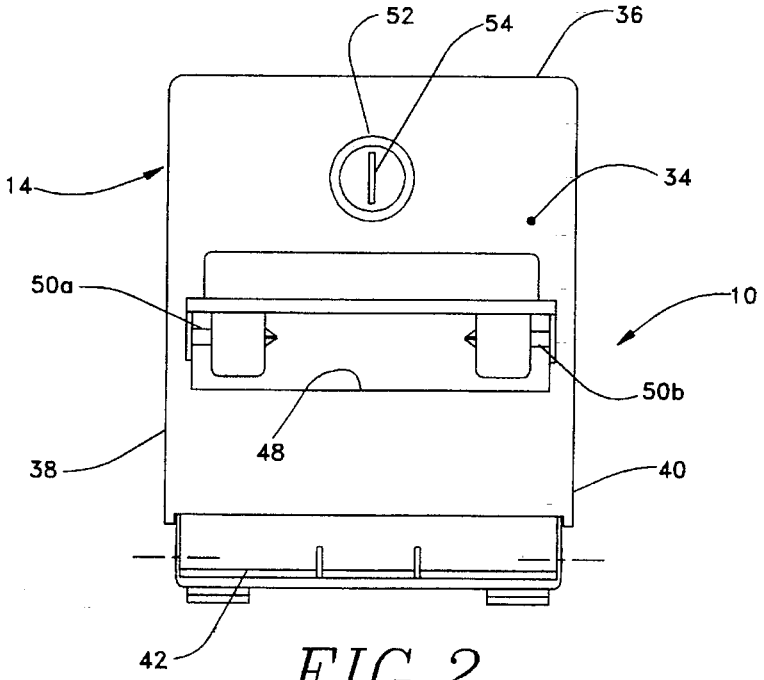
FIG. 2 is a rear view in elevation of the preferred embodiment of FIG. 1.

Formed in the bottom rear corner of the sidewalls 22 and 24 are holes **32*a* and 32*b*. The door 14, as best shown in FIGS. 1 and 2, has a vertical face 34, a horizontal top flange 36 and a pair of vertical side flanges 38 and 40. A bottom edge 42 of the door 14 is generally cylindrical in shape and has a pair of stub shafts 44*a* and 44*b* at opposite ends. The stub shafts 44*a* and 44*b* are designed to be receivably journaled in the holes 32*a* and 32*b* of the housing sidewalls 22 and 24. When the door 14 is in the closed position, as best shown in FIG. 1, the horizontal top flange 36 and the vertical side flanges 38 and 40 of the door 14 encompass and provide a close fit with the housing 12**.

The vertical door face 34 is formed with a horizontal opening 48 that extends almost the full with of the door 14 and is provided at each end with a pair of slotted posts **50*a* and 50*b* (FIG. 2) for receiving the rollers 16*a* and 16*b* respectively. Also provided in the vertical face 34 of the door 14 is an opening shown generally at 52 for installation of a commercially available key actuated cam lock assembly 54**.

Figure 3:
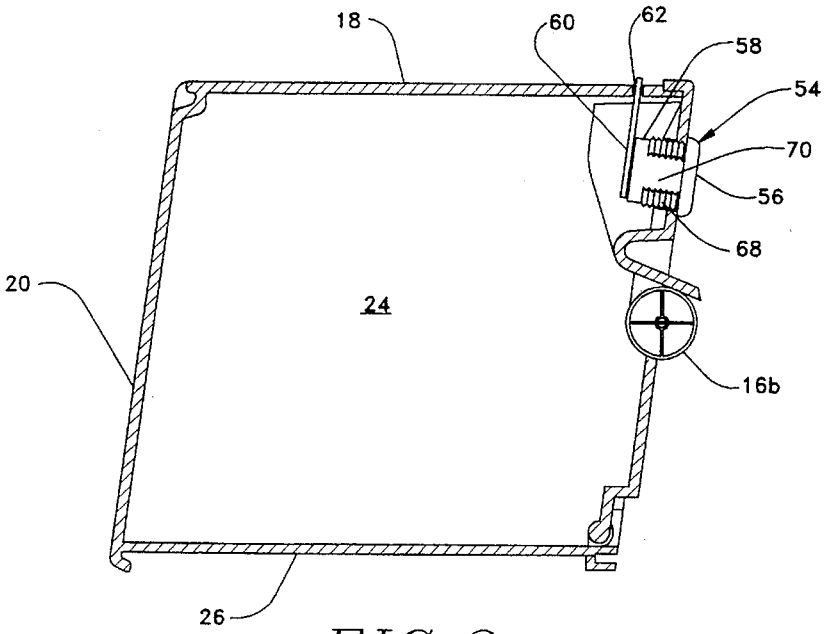
FIG. 3 is a cross-sectional view of the preferred embodiment of FIG. 1 taken along line 3—3 of FIG. 1.

Referring now to FIG. 3, the lock assembly 54 includes a head portion 56, a body portion 58 and a latching arm portion 60. When the door 14 is closed, as best shown in FIGS. 1 and 3, the lock assembly 54 can be actuated by a key to cause rotation of the arm 60 so that it engages a slot 62 in the housing top wall 18 to secure the door 14 to the housing 12.

To semi-permanently secure the lock assembly 54 in the door 14, means are formed on-the door 14 and the lock assembly 54 to coact together upon insertion of such assembly 54 into the door opening 52. The securing means are formed by projections on the exterior of the lock assembly body portion 58 and the periphery of the door opening 52.

The projections on the lock assembly body portion 58 are formed by threads 68 that partially circle the portion 58. The threads 68 do not encompass the entire exterior surface of the body portion 58, but instead are separated by flat side portions 70 on each side of the body portion 58 for a purpose to be described below.

Figure 4:
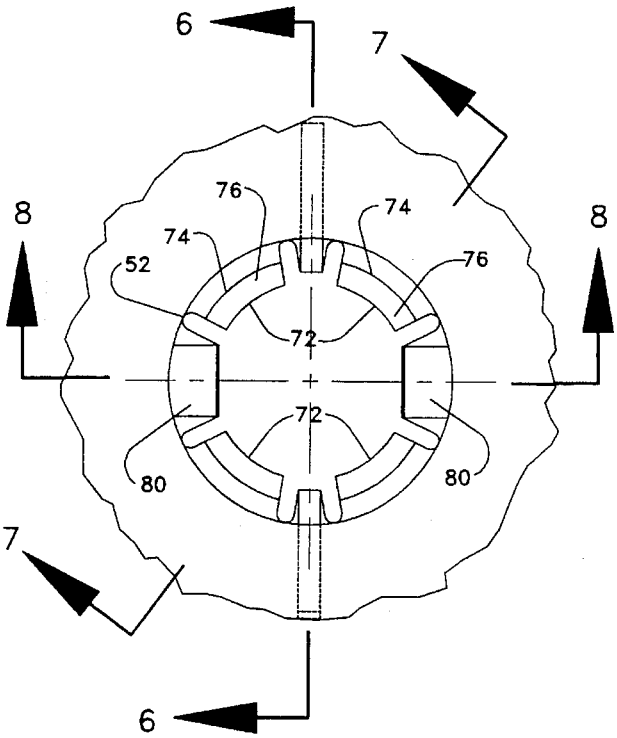
FIG. 4 is an exterior view of a fragmentary portion of the exterior door showing the opening for the lock with the lock removed.
Figure 5:
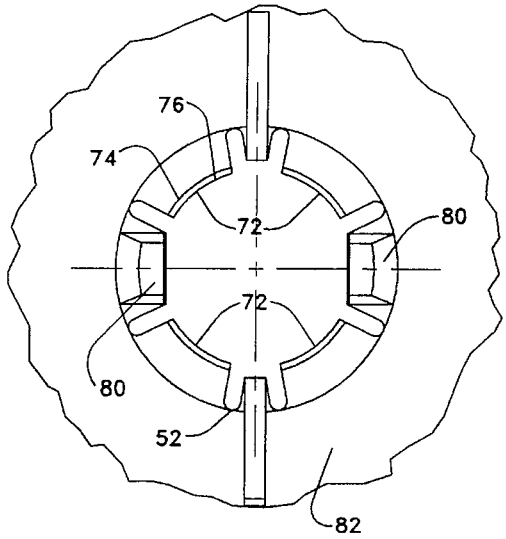
FIG. 5 is an interior rear view of a fragmentary portion of the door showing the opening for the lock with the lock removed.

As indicated best by FIGS. 4, 5 and 7, the securing means on the door 14 are formed by preferably four tabs 72, that radially extend into the door opening 52. Outer ends 74 of the tabs 72 have inclined surfaces 76 to facilitate insertion of the locked body into the door opening 52. However, as indicated by FIG. 9, once the lock assembly 54 is inserted into the opening 52, the tabs 72 extend into the depressions between the threads 68 to prevent the backing out of the lock assembly 54 from the door 14 without the use of a large amount of force to do so. By utilizing four of the tabs 72, the retaining action of such tabs on the lock assembly 54 is spread around the circumference of the body 58 to provide a positive securement action.

In addition to the tabs 72, the periphery of the door opening 52 also includes a pair of alignment piers 80*a* and 80*b* that project outwardly from a rear surface 82 of the door 14. As shown best by FIGS. 8 and 11, the piers 82 have flat side oppositely facing surfaces 84 with a width substantially equal to the width of the flat sides 70 of the lock assembly body 58. To insert the lock assembly 54 into the opening 52, it is necessary for the flat sides 70 of the lock assembly body 58 to be aligned with the flat surfaces 84 of the piers 80*a* and 80*b* to insure that the lock assembly 54 is oriented in the correct position in the door 14. Also, the piers 80*a* and 80*b* serve to prevent side-to-side wobbling of the lock assembly 54 in the opening 52.

Located at the top and bottom of the door opening 52 are narrow struts 88*a* and 88*b* that, like the piers 80*a* and 80*b*, also project outwardly from the rear surface 82 of the door 14 as shown by FIGS. 6 and 9. The struts 88a and 88b are spaced apart a selected distance so as to be closely adjacent respectively the top and bottom of the lock assembly body portion 58 to serve as stabilizers that not only limit up and down wobble of the lock assembly body 58 with respect to the door 14, but also increase the strength of the door 14.

Thus, the present invention provides a structure that permits the quick and expeditious installation of the lock assembly 54 into the door 14 in a fashion that secures such assembly in a semipermanent relationship with the door. Although the present invention has been described with reference to the preferred embodiment, it should be understood by those skilled in the art that changes can be made in the structure of such embodiment without departing from the true spirit and scope of the invention.

I claim:

1. A hinged access display and dispensing device for lottery-type tickets or the like comprising:

(a) a housing of box-like configuration having a floor, a roof, a pair of sidewalls, a front end and an open rear end;

(b) a door pivotally attached to the rear end of said housing and having an opening;

(c) a lock assembly positioned in said door opening and having a head portion located adjacent the exterior of said door and a body portion extending from said head portion through said opening;

(d) securing means extending into said opening of said door for substantially preventing removal of said lock assembly from said door opening, said securing means being of a sufficiently resilient construction to allow insertion of said lock assembly into said door opening, while substantially preventing removal therefrom; and (e) wherein the securing means consists of projections provided on a periphery of the door opening, which projections engage projections provided on an exterior of the lock assembly body portion to secure said lock assembly in said opening.

2. A display device according to claim 1 wherein said projections on said lock assembly body portion are in the form of threads and the projections on said door opening periphery are in the form of tabs that extend into said opening.

3. A display device according to claim 2 wherein said tabs each have a free end portion with an inclined surface to facilitate the positioning of said lock assembly body into said door opening and impeding the removal of said body from said opening.

4. A display device according to claim 3 wherein there are at least four of said tabs evenly spaced about said door opening.

5. A display device according to claim 1 wherein said door and said lock assembly include means for positioning the lock assembly in a desired relationship with respect to the door.

6. A display device according to claim 1 wherein said door includes at least one post orthogonal to said opening and said lock assembly body portion has at least one longitudinally extended flat surface that coacts with said post to prevent rotation of said lock assembly with respect to said door.

* * * * *